US010329706B2

(12) United States Patent
Moens

(10) Patent No.: US 10,329,706 B2
(45) Date of Patent: Jun. 25, 2019

(54) DEVICE FOR DOSING AND DISPENSING A DETERGENT COMPOSITION

(71) Applicant: BIIP cvba, Diegem (BE)

(72) Inventor: Marnix Moens, Kampenhout (BE)

(73) Assignee: BIIP cvba, Diegem (BE)

( * ) Notice: Subject to any disclaimer, the term of this patent is extended or adjusted under 35 U.S.C. 154(b) by 0 days.

(21) Appl. No.: 15/113,686

(22) PCT Filed: Jan. 24, 2015

(86) PCT No.: PCT/EP2015/051422

§ 371 (c)(1),
(2) Date: Jul. 22, 2016

(87) PCT Pub. No.: WO2015/110615

PCT Pub. Date: Jul. 30, 2015

(65) Prior Publication Data

US 2017/0101735 A1 Apr. 13, 2017

(30) Foreign Application Priority Data

Jan. 24, 2014 (EP) ..... 14152495

(51) Int. Cl.
*D06F 39/02* (2006.01)

(52) U.S. Cl.
CPC ..... *D06F 39/024* (2013.01); *D06F 39/022* (2013.01)

(58) Field of Classification Search
CPC ..... D06F 39/024; D06F 39/022
See application file for complete search history.

(56) References Cited

U.S. PATENT DOCUMENTS

| | | | | |
|---|---|---|---|---|
| 4,776,455 | A | 10/1988 | Anderson et al. | |
| 4,835,804 | A | 6/1989 | Arnau-Munoz et al. | |
| 4,874,107 | A * | 10/1989 | Arnau-Munoz | D06F 39/024 220/23.87 |
| 5,129,120 | A | 7/1992 | Cornette et al. | |
| 5,355,541 | A | 10/1994 | Rutter et al. | |
| 5,551,604 | A | 9/1996 | Kern et al. | |
| 5,768,917 | A | 6/1998 | Freida | |
| 6,736,294 | B2 * | 5/2004 | Smith | D06F 39/024 222/463 |
| 2006/0288600 | A1 * | 12/2006 | Taylor | D06F 58/203 34/60 |
| 2007/0022971 | A1 | 2/2007 | Renforth et al. | |
| 2009/0300933 | A1 | 12/2009 | Howe et al. | |
| 2009/0307924 | A1 | 12/2009 | Aouad et al. | |
| 2011/0132781 | A1 | 6/2011 | Willat et al. | |
| 2012/0023678 | A1 | 2/2012 | Smulowitz | |

(Continued)

FOREIGN PATENT DOCUMENTS

| | | |
|---|---|---|
| CN | 2486575 | 4/2002 |
| CN | 2892923 | 4/2007 |

(Continued)

*Primary Examiner* — Joseph L. Perrin
(74) *Attorney, Agent, or Firm* — Levy & Grandinetti

(57) ABSTRACT

The present invention relates to a device for dosing and dispensing a detergent composition. The device is defined by an outer container comprising at least an opening in fluid communication with an outer atmosphere. The device has an inner reservoir comprising at least an opening. The inner reservoir of the device comprises no opening that opens directly into the outer atmosphere.

11 Claims, 3 Drawing Sheets

(56) References Cited

U.S. PATENT DOCUMENTS

| | | | | |
|---|---|---|---|---|
| 2014/0033447 | A1* | 2/2014 | Di Bono | D06F 39/024 8/137 |
| 2015/0299933 | A1* | 10/2015 | Oh | D06F 39/024 510/513 |

FOREIGN PATENT DOCUMENTS

| | | |
|---|---|---|
| DE | 88 01 921 | 6/1989 |
| DE | 100 27 951 | 1/2002 |
| EP | 2 108 068 | 7/2008 |
| EP | 2 481 687 | 8/2012 |
| KR | 10-1222784 | 1/2013 |
| WO | WO 00/05144 | 2/2000 |
| WO | WO 2005/047119 | 5/2005 |
| WO | WO 2008/152362 | 12/2008 |
| WO | WO 2012/095649 | 7/2012 |

* cited by examiner

DEVICE FOR DOSING AND DISPENSING A DETERGENT COMPOSITION

FIELD OF THE INVENTION

The present invention relates to a device for dosing and dispensing a detergent composition, said device being defined by outer container comprising at least an opening in fluid communication with an outer atmosphere and an inner reservoir comprising at least an opening, said device characterized in that the inner reservoir comprises no opening that opens directly into the outer atmosphere.

BACKGROUND OF THE INVENTION

Obtaining a homogeneous washing liquor during laundry cleaning process in a washing machine is a very important factor for obtaining a satisfactory end-result.

Efficient dosing and dispensing is key for ensuring that the given amount of detergent is used at its maximum capacity within the washing machine. This requirement becomes even stricter especially in cases when the detergent compositions comprise several detergent active compounds which need to interact in the washing liquor but should not interact when present in the detergent composition itself; for example, when liquid detergent compositions contain bleaching active compounds which could interact with bleach sensitive detergent ingredients such as enzymes.

There currently exist several devices suitable to be used during cleaning processes in a washing machine. Examples of such devices with a single dosing chamber include for example the devices described in US2012023678 or EP2108068, directed to dispensing a limited quantity of detergent compositions throughout a washing cycle. Another similar device is known for deodorizing linen during air drying is described in US2009300933. The outer shell of the device of US2009300933 instead of directly accommodating a cleaning solution, comprises a core made of a sponge impregnated with a deodorizing substance that is released through the openings in the shell during a drying process.

Several two-vessel-based solution are also known in the art and include for example U.S. Pat. No. 4,835,804 that discloses a device for laundry washing, comprising an outer container for retaining one detergent composition and further containing also an inner reservoir for retaining another detergent composition that is incompatible with the first detergent composition retained in the outer container. Both outer container and the inner reservoir of the device of U.S. Pat. No. 4,835,804 open directly to the outer atmosphere and release their concentrated contents onto the surrounding laundry through separate openings directly communicating with the outside of the device (i.e. unmixed). Another two-chamber device is known from KR101222784 which comprises an internal reservoir retaining a detergent composition and opening directly to outer atmosphere for the purpose of releasing said composition directly onto the laundry undergoing a wash, and an outer container surrounding the lateral sides of said inner reservoir, said outer container retaining a plurality of porous ceramic balls for emitting far-infrared radiation participating in water activation during the washing process. As in U.S. Pat. No. 4,835,804, the inner compartments of the two vessels forming the device of KR101222784 are not in direct fluid communication with one another. In contrast, U.S. Pat. No. 5,355,541 teaches a two-vessel device for a stain pre-treatment prior to washing fabrics in a washing machine, wherein the outer container retaining a liquid detergent composition does not communicate with the outer atmosphere but is in direct fluid communication with a partially container therein inner reservoir. This inner reservoir on the other hand comprises application means, such as a sponge or a wick-like element, which extends to the outer atmosphere outside the device and serves the purpose of controlled distributing of the detergent composition directly onto stains. For better understanding of how the above listed 2—vessel devices are made, FIG. 1 provides their schematic representation (A—the device of U.S. Pat. No. 4,835,804; B—the device of KR101222784; C— the device of U.S. Pat. No. 5,355,541; reference numbers refer to: 1—inner reservoir; 2—inner reservoir opening, 3—outer container; 4—outer container opening; d—detergent composition)

Unfortunately, all of the afore-listed devices fail to obtain a homogenized washing liquor capable of distributing evenly in the washing machine. Due to the difference in viscosity between water and the cleaning solution, once the detergent composition leaves the dosing device, it will substantially enter in contact with only specific items present in the washing machine and adhere to them. Since only a minimum concentration of cleaning solution will reach the rest of the items, these items will be less efficiently washed and may have to be rewashed.

Therefore it is clear from the above that there remains a need on the market for a dosing and dispensing device comprising an interspace acting as a dilution chamber which provides for a more homogenized washing liquor ensuring a more efficient laundry cleaning process.

It is another object of the present invention to provide a device suitable for dosing and dispensing detergent compositions, either granulated or liquid, in particular detergent compositions having bleach sensitive detergent active compounds.

It is a further object of the present invention to provide a device capable of controlling the dispensing of the detergent composition throughout the total duration of the cleaning process.

SUMMARY OF THE INVENTION

The present invention is directed to device for dosing and dispensing a detergent composition, said device comprising:

- an outer container (or, simply, container) defined by a container wall forming a container internal compartment and comprising at least one container opening for brining said container internal compartment in fluid communication with an outer atmosphere;
- an inner reservoir (or, simply, reservoir) defined by a reservoir wall forming a reservoir internal compartment for retaining a detergent composition, said reservoir being at least partially contained in said container thus defining an interspace between the container wall and the portion of the reservoir wall contained in the container, said reservoir wall further comprising a reservoir opening bringing said reservoir internal compartment in fluid communication with said interspace, said device characterized in that the reservoir comprises no opening that opens directly into the outer atmosphere.

By ensuring that all openings of the inner reservoir are in fluid contact with the interspace only and not with the outer atmosphere, during a washing cycle, water entering into the interspace of the present device will come into contact with the detergent comprised in the inner reservoir only through the inner reservoir openings. Such arrangement leads to the gradual dilution of the detergent in water, followed by its spreading into the interspace serving as a dilution chamber.

From said chamber, the diluted detergent composition may become evenly and gradually distributed over the different laundry pieces present in the agitating washing machine drum during a washing cycle.

In a preferred embodiment according to the present invention, the reservoir opening does not directly face the container opening, i.e. the fluid exiting from the inner reservoir opening into the interspace first faces an inner wall of the outer container when following a straight-line fluid flowpath and does not directly enter into the outer container opening following a straight-line flowpath. Such arrangement of openings ensures longer residence time of the diluted detergent inside of the interspace and thus also a better control over its distribution in space and time inside the washing machine drum during a washing cycle.

In an advantageous embodiment of the above-described embodiment, the reservoir opening and the container opening face opposite sides of the device.

In another embodiment according to the present invention, reservoir internal compartment comprises a detergent composition.

Preferably the detergent composition is liquid, as used herein the term including liquid, paste, gel, or waxy compositions. But possibly, the detergent composition can also be in a solid form such as: powder, granular and/or agglomerates and/or flakes.

Should the detergent composition be an aqueous concentrate capable of flowing or oozing from within the reservoir internal compartment, in an advantageous embodiment, the reservoir opening may be further coated by a water soluble film for preventing the detergent composition from exiting through the reservoir opening prior to contact with water. Such films are well known in the art and can either be applied specifically onto the reservoir openings or generally cover the entire reservoir.

In an alternative and advantageous embodiment, the detergent composition is provided in a form which, under standard conditions for temperature and pressure, prior to its at least partial dispersion or dilution in water, does not spontaneously exit through the reservoir opening and enter into the interspace defined between the container wall and the portion of the reservoir wall contained in the container. Such embodiment provides for the highly desired very gradual dispersion of the detergent composition inside of the washing machine, as only by contact with water the detergent solution retained inside of the reservoir internal compartment will obtain sufficient flow properties for entering into the device's interspace. Once in the interspace, the detergent composition becomes even better mixed with water from the washing machine and as a consequence, its flow properties become even more advantageous for exiting the device and spreading over the wet laundry surrounding the device inside of the agitating washing machine drum.

In a particularly advantageous embodiment, the reservoir is detachably removable from the container and can be interchanged for another reservoir. By being interchangeable for another compatible reservoir, the device of the present invention can possibly be commercialized in the form of a kit of parts comprising the outer container and several detergent-retaining interchangeable reservoirs. In a possible embodiment, the interchangeable reservoirs may potentially also be available for purchasing separately In line with the above-described embodiment, the outer container could possibly be produced from more durable material than the inner reservoir, and possibly also be equipped with additional surface modifications providing additional functionalities to the device of the invention as a whole.

For example, in a preferred embodiment, the external surface of the container wall may comprise a plurality of protrusions, said protrusions preferably comprising a material selected from a group consisting of plastic, rubber, or fiber.

In a further embodiment of the above embodiment, at least a number of said plurality of protrusions can further comprise an opening.

In another preferred embodiment, the container may comprises dosage means such as an attachment capable of having a revolvably adjustable position over the container opening or a vertically-slidable element that can be partially to entirely slid over the container opening so as to vary the area of said opening.

On the other hand, in alternative embodiments, the inner reservoir can also comprise different functional modifications.

For example, in one preferred embodiment, the inner reservoir may comprise at least two inner reservoir compartments, which would allow the user of the device of the invention to use at least two detergent compositions for the same washing cycle.

In another possible embodiment, for further enhancing the transfer of the detergent composition into the washing liquor, the container wall can comprise a plurality of openings for brining said container internal compartment in fluid communication with an outer atmosphere.

Similarly, in a further embodiment compatible with any of the afore-mentioned embodiments, the reservoir wall can also comprise a plurality of openings which open into the interspace defined between the container wall and the portion of the reservoir wall contained in the container and do not directly open into the outer atmosphere.

In a preferred embodiment, the mean distance between the container wall and the portion of the reservoir wall contained in the container defining the interspace is at least 5 mm.

In an alternative embodiment, for further better mixing of the detergent composition with water entering into the device interspace from the washing machine, the reservoir or its portion contained in the container can be capable of performing movements, e.g. rotational movements, within said container. For instance, for an inner reservoir entirely contained in the outer container, such ability to perform such movements in water can for be provided by incorporation of complementary circular or spiral threads extending from the inner side of the container wall and the outer side of the reservoir wall.

Further, the present invention is also directed to a use of the device as a laundry device.

In another embodiment, the present invention also provides a use the reservoir, preferably comprising a detergent composition, with the device according to the invention.

The present invention is also directed to a kit of parts comprising: a receptacle such as a bottle or a tube comprising detergent composition, and a device according to any of the above-listed embodiments for dosing and dispensing the detergent composition, wherein said device is removably attachable to said receptacle so as to fill in or replenish the detergent composition retainable in the reservoir internal compartment.

Finally, the present invention is also directed to a process for washing textiles in a washing machine with the device according to the present invention. In a preferred embodiment a process is concerned comprising the steps of: adding detergent composition in the inner reservoir, placing the inner reservoir in the outer reservoir and securing the outer reservoir, placing the device for dosing and dispensing a detergent composition inside the washing machine together with the textiles.

In another embodiment, a process is provided comprising the steps of: placing textiles inside the washing machine together with the device according to preceding claims x-z, said device comprising a detergent composition in the reservoir (1); and running the washing machine.

BRIEF DESCRIPTION OF THE DRAWINGS

FIG. 1 schematically illustrates possible embodiments of the device according to the present invention, wherein A—the device wherein the inner reservoir (1) is entirely comprised within the outer container (3); B and C—two different embodiments of the device wherein the inner reservoir (1) is only partially comprised within the outer container (3). Reference numbers refer to: 1—inner reservoir; 2—inner reservoir opening, 3—outer container; 4—outer container opening; 6—fixing means such as fins; d—detergent composition. Hatched lines schematically show the attachment zones where a vessel is comprised of two or more assemblable parts.

DESCRIPTION OF THE INVENTION

Figure 1:
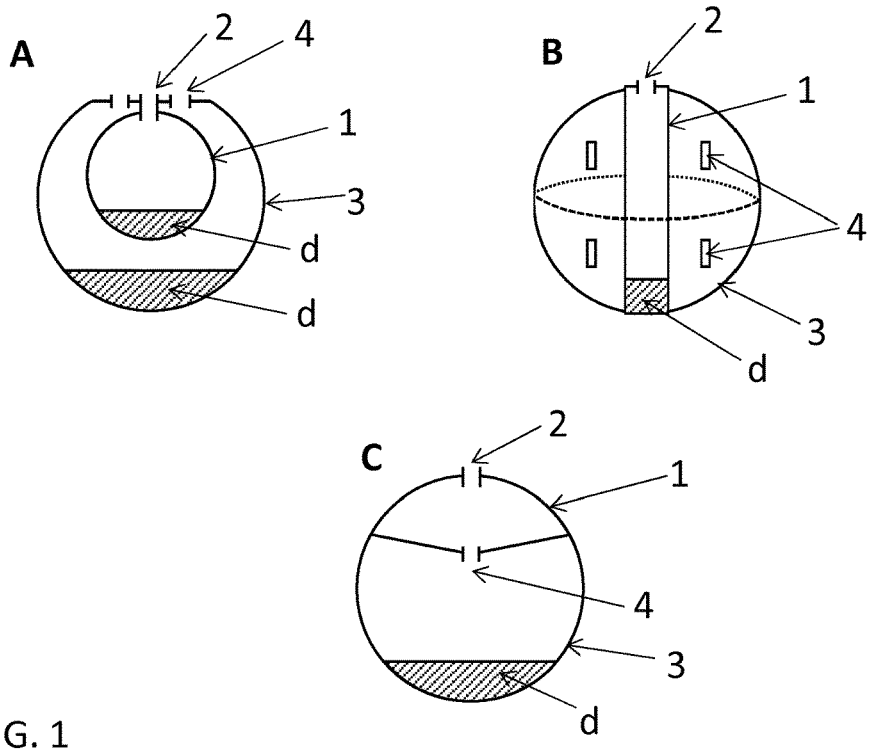
FIG. 1 schematically illustrates two-vessel devices known from prior art, wherein A—the device of U.S. Pat. No. 4,835,804; B—the device of KR101222784; C— the device of U.S. Pat. No. 5,355,541. Reference numbers refer to: 1—inner reservoir; 2—inner reservoir opening, 3—outer container; 4—outer container opening; d—detergent composition. Hatched lines schematically show the attachment zones where a vessel is comprised of two or more assemblable parts.
Figure 2:
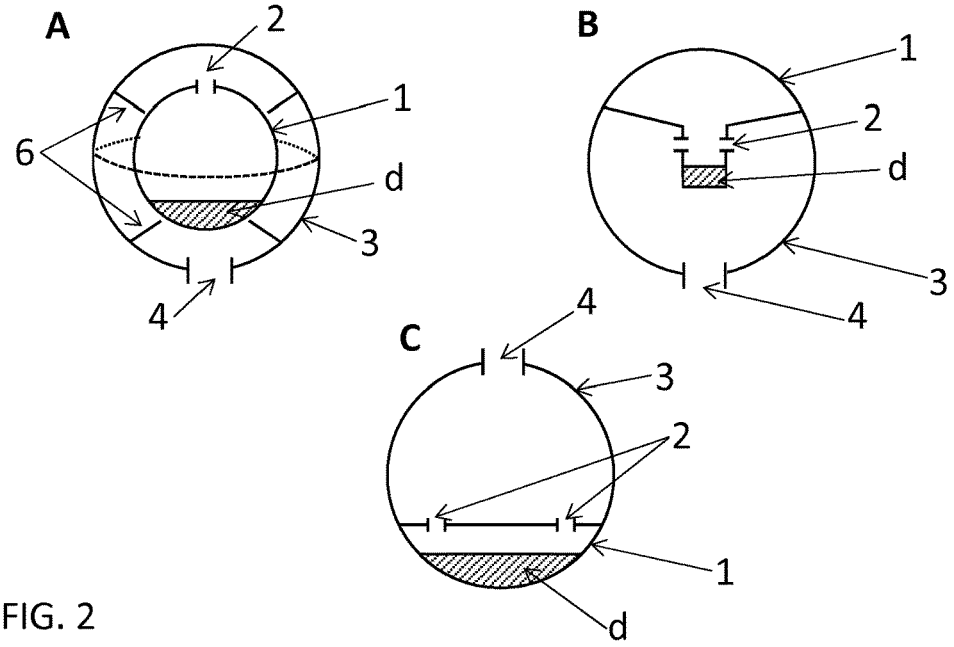

FIG. 1 schematically represents three different possible embodiments of the device according to the present invention, wherein an interspace serving as a dilution chamber is formed between the internal side of the outer container (3) wall and the external side of the portion of the inner reservoir (1) wall contained in said outer container (3). The embodiment shown in FIG. 1 A depicts a device wherein the inner reservoir (1) is entirely comprised within the outer container (3), whereas the two embodiments shown B and C schematically illustrate two different devices wherein the inner reservoir (1) is only partially comprised within the outer container (3).

Figure 3:
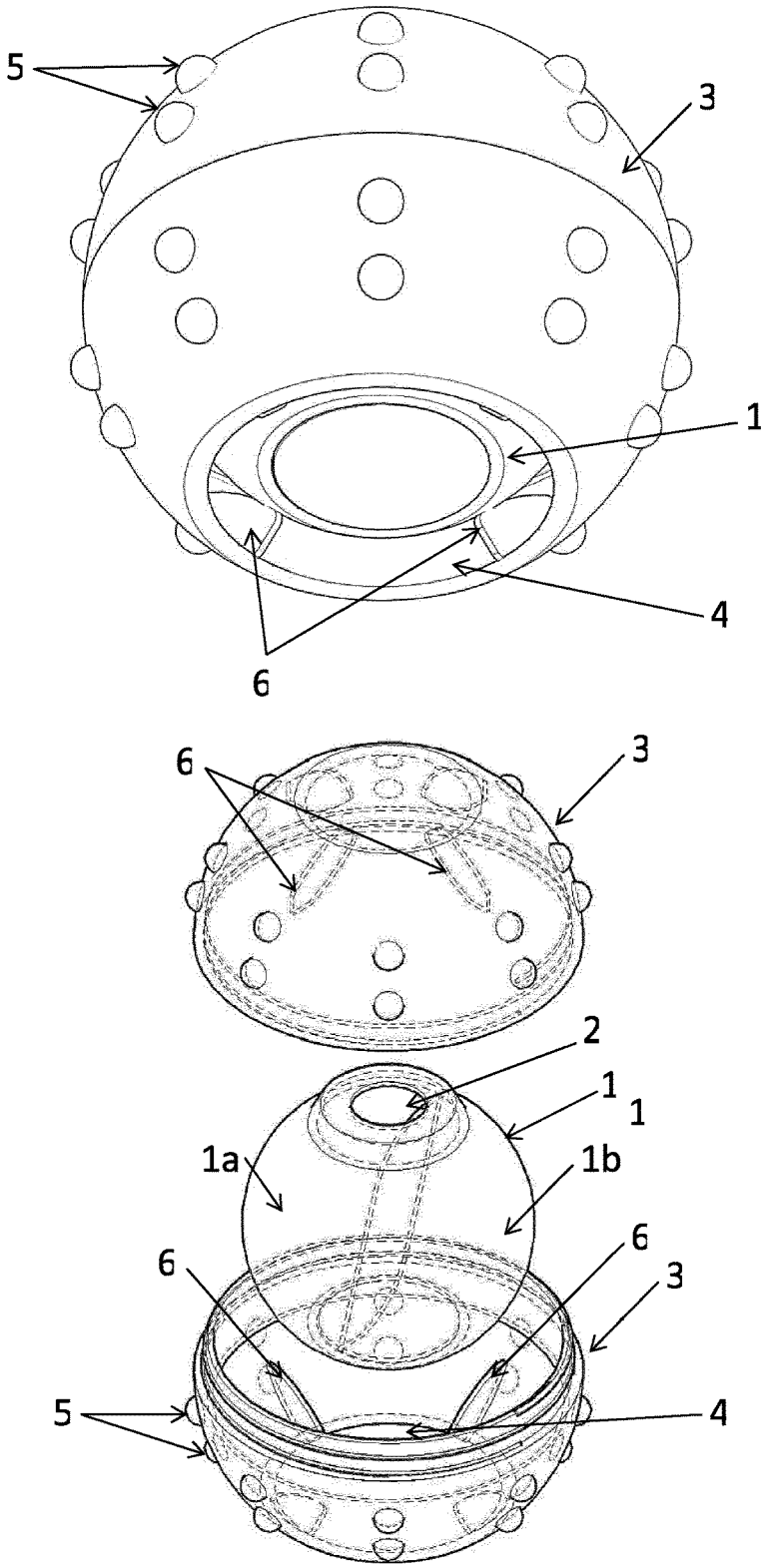
FIG. 3 schematically represents an embodiment of the device according to the present invention, wherein the inner reservoir (1) is entirely comprised within the outer container (3), and wherein the outer container (3) wall comprises plurality of protrusions (5).

FIG. 3 represents a possible preferred embodiment of the device for dosing and dispensing a detergent composition according to the present invention, said device comprising at least two vessels:

a first outer hollow container (3) defined by a spherical container wall forming from the inside a container internal compartment and from the outside comprising a plurality of protrusions (5), said wall comprising at least one container opening (4) for brining said container internal compartment in fluid communication with an outer atmosphere; and an inner also hollow and cylindrical reservoir (1) contained in said container (3), said reservoir (1) defined by a reservoir wall from the inside forming a reservoir internal compartment for retaining a detergent composition and from the outside defining an interspace (serving as the dilution chamber) together with the inside of the container wall, said reservoir wall further comprising a reservoir opening (2) opening exclusively into the interspace and not to the outer atmosphere and thus bringing said reservoir internal compartment in fluid communication with said interspace.

In the context of the present invention, a detergent composition is to be understood as any type of product used in the cleaning process of textiles, like for example: cleaning agent (liquid or solid form such as: powder, granular and/or agglomerates and/or flakes), softener, rinsing solution, salt or a combination thereof. The detergent composition may comprise washing additives, like bleaches, enzymes or the like. The term liquid is meant to include liquid, paste, gel or waxy compositions.

Indeed, because the inner reservoir (1) is contained in the outer container (3), the interspace is defined between the two, allowing the detergent composition to be first dissolved or diluted in water and afterwards to leave the outer container (3) and enter in contact with the items to be washed. Due to this process, the detergent composition, which initially is highly viscous, will exit the device in a diluted state. The result is a homogenized washing liquor within the entire washing machine.

Furthermore, the internal movement of the washing machine induces a rotational movement of the device and also constantly changes the trajectory of said device. Accordingly, the device itself comes in intense contact with the items to be washed and considerably enhances the cleaning process. In particular, the device of the presented herein particular embodiment will have a physical cleaning ability because of the protrusions (5). At the same time, a quantity of detergent composition will be released from the device and enter in contact with the items to be washed, creating a powerful synergetic effect between the physical cleaning ability of the device and the cleaning ability of the detergent composition.

An advantage of this synergetic effect is that the washing process is more efficient with a better result in removing difficult stains. Another advantage is that the washing process is cost and time effective as the time, quantity of detergent composition and water are reduced significantly.

In a preferred embodiment according to the present invention, the openings of both the inner reservoir (2) and the outer container (4) are placed on opposite sides. This structural characteristic increases the time in which the detergent composition leaves the interspace within the device and enters in contact with the items present in the washing machine, allowing for a pre-dissolution of the detergent composition irrespective the form: liquid, solid, powder or any other form. Furthermore, it also increases the overall efficiency by allowing for a more controlled dispersing of the detergent composition throughout the total duration of the cleaning process.

The outer container (3) preferably comprises two parts: an upper and a bottom part. This is done to enable easy opening of the device for the purpose of (re)filling the inner reservoir (1) with the detergent composition. The upper and the bottom parts are preferably engaged to each other by fixing means. Such fixing means include: snap fittings, connectors, a connecting rim, a thread or the like and should allow the upper and the bottom part to be revolved easily. In one embodiment, the inner reservoir (1) can be manufactured in one piece together with the bottom part of the outer reservoir (3).

In another embodiment according to the present invention, the reservoir (1) is interchangeable, so when empty, the entire reservoir (1) is replaced with a new one. Thanks to this feature, the person using the device according to the present invention is not entering in direct contact with the detergent composition, eliminating the risk of potentially unwanted allergic reactions.

In another embodiment according to the present invention, the reservoir (1) comprises predefined marked dosing levels on its surface, allowing the user to easily add the desired quantity of the detergent composition.

In another embodiment according to the present invention, the two parts of the outer container (3) comprise fixing means such as fins (6), securing the reservoir (1) within the container (3). Said fixing means also have an effect of guiding the detergent composition towards the container opening (4) and also improve the dissolving process.

In another embodiment according to the present invention, the reservoir (1) comprises at least two internal compartments (1*a*, 1*b*), possibly at least three internal compartments or at least four internal compartments. Such a structural characteristic allows said device to be used with at least two different detergent compositions which should not interact with each other while contained in the reservoir (1). Such arrangement is particularly important for detergent compositions having for example bleach sensitive active compounds. Such a reservoir (1) is also suitable for usage with more complex cleaning programs like: bleaching and washing, washing and rinsing, washing and softening, bleaching and washing and softening, or the like.

Further, the mean distance between the container (3) wall and the portion of the reservoir (1) wall contained in the container (3) defining the interspace, is at least 5 mm, preferably at least 7 mm, more preferably, at least 10 mm, or most preferably at least 15 mm.

In another embodiment according to the present invention, the reservoir (1) can take the form of a sphere or a half-sphere having a diameter of at least 55 mm, preferably at least 65 mm, more preferably 75 mm, most preferably at least 85 mm, and having at least one opening (2) of at least 5 mm, preferably at least 10 mm, more preferably at least 20 mm, most preferably at least 30 mm. Further, the outer container (3) can also take the form of a sphere or a half-sphere having a diameter of at least 55 cm or 60 mm, preferably of at least 70 mm, more preferably of at least 90 mm or even 100 mm. These dimensions are generally suitable to provide for the device according to the present invention to be usable in different applications that require different quantities of detergent composition.

In a possible embodiment according to the present invention, inner reservoirs (1) of different diameters are usable with the same outer container (3).

In another embodiment according to the present invention, the outer container (3) comprises dosage means such as a revolvable or a slidable attachment allowing to vary the size of said container opening (4) depending on the type of detergent composition (liquid or granulated), the desired amount of the detergent to be used in a washing programme, or the type and the length of the programme.

Figure 4:
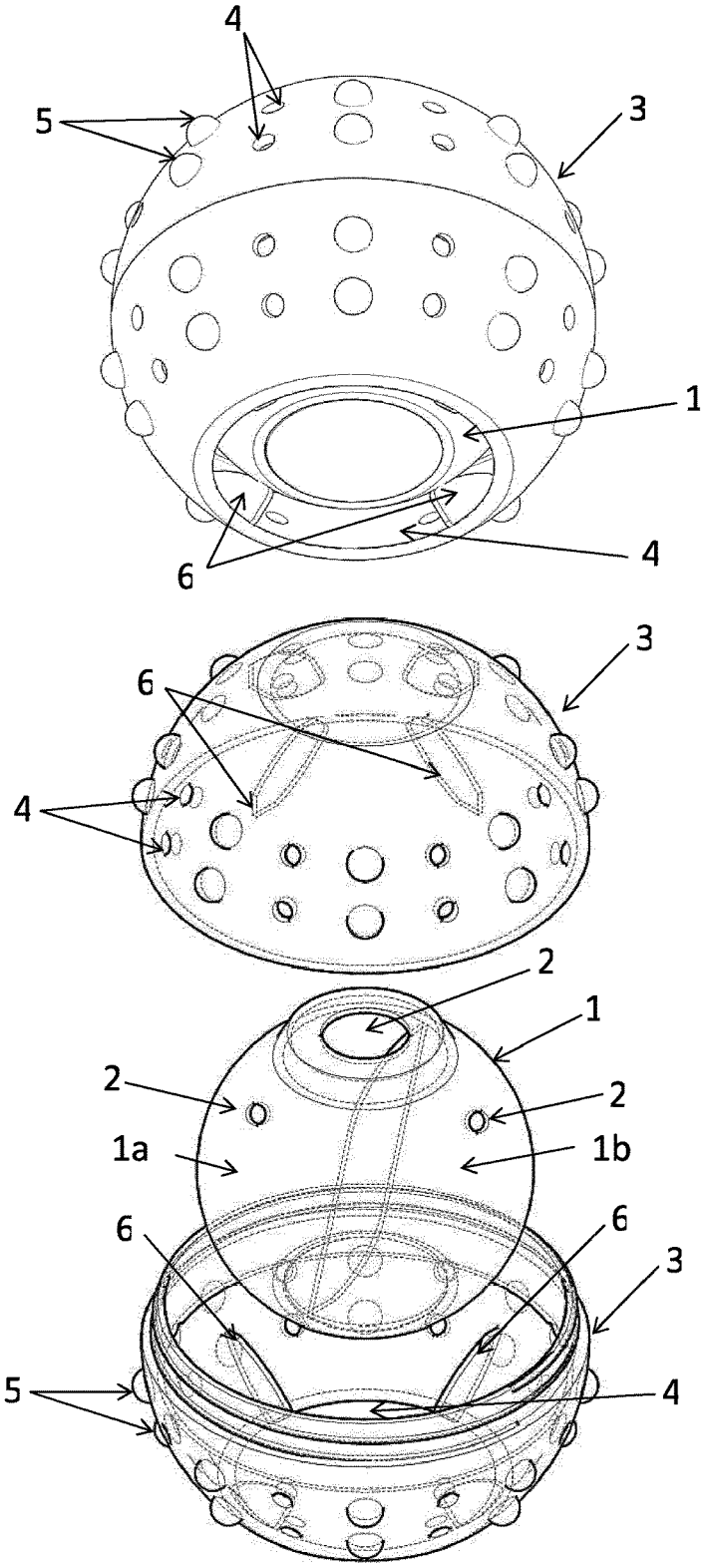
FIG. 4 schematically represents an embodiment of the device shown in FIG. 3 wherein the inner reservoir (1) and the outer container (3) comprise additional (more than a single one per vessel) inner reservoir openings (2) and the outer container openings (4), respectively.

In another embodiment according to the present invention and as presented in FIG. 4, the outer container (3) wall comprises a plurality of openings (4), making the transfer of the dissolved detergent composition from the interspace within the device into the washing machine even faster and more efficient.

In a yet another embodiment according to the aforementioned embodiment, the outer container (3) comprising the plurality of openings (4) in the container wall, also comprises the dosage means such as the revolvable or slidable attachment for varying the size of at least one opening (4), usually the biggest or main opening. For example, such main opening can be completely closed by positioning such revolvable attachment over the entire area of said opening, or it can be partially closed by positioning of such attachment only over a portion of the area of said container opening.

In another embodiment according to the present invention the device for dosing and dispensing a detergent composition comprises at least two reservoirs: a first inner hollow spherical reservoir (1) having at least an opening (2) in which the detergent composition is inserted, an outer hollow spherical container (3) comprising at least a dispersing opening (4), wherein the inner reservoir (1) is contained in the outer reservoir (3), the outer container (3) further comprises dosage means and no protrusions on the exterior surface.

In another embodiment according to the present invention, the inner reservoir (1) wall comprises a plurality of openings (2) which open into the interspace defined between the container (3) wall and the portion of the reservoir (1) wall contained in the container (3) and do not directly open into the outer atmosphere. Depending on the application, said openings may be of different diameters to allow for a bigger or smaller quantity of detergent composition exiting the inner reservoir (1) into the interspace and being dissolved or diluted in water. Further, in another embodiment according to the present invention, the inner reservoir (1) comprises a plurality of openings (2) on its surface with different diameters or shapes depending on their location with respect to the location, size, or shape of the openings (4) of the outer container (3). For example the diameter of the inner reservoir openings (2) would be bigger where they would face the container (3) wall comprising no or very small container openings (4). Analogously, the reservoir openings (2) would be smaller where they would be facing container (3) wall comprising big or numerous container openings (4). Such structural modification speeds up the distribution of the detergent compositions as allows its bigger quantity to enter in contact with water through the numerous reservoir openings (2) simultaneously, and as a consequence pass to the interspace faster, from which it can also more rapidly exit the container (3) in a well-diluted state.

In another preferred embodiment according to the present invention, both the inner reservoir (1) and the outer container (3) may comprise the dosage means, such as the revolvable or slidable attachment or an fixable lid optionally with various degree of perforations. As it was mentioned before, such dosage means allow varying the size of any selected opening of the reservoir (1) or the container (3), can be placed on one reservoir opening (2) and/or container opening (4), preferably being the biggest opening on a given vessel (1 or 3), or on several openings (2 or 4) on one of or both vessels (1 or 3). Because of this feature, the same device can be adjusted to be used for many different types of detergents, washing programmes, item types or levels of dirt.

In one of preferred embodiments of the invention, the inner reservoir (1) comprises at least two inner compartments (1*a*, 1*b*), making the device suitable for use with at least two different detergent compositions which should not interact with each other while contained in the inner reservoir (1). Of course, in alternative embodiments, each of the internal inner reservoir compartments (1*a*, 1*b*) can be of different capacity, shape, or can comprise different number of inner reservoir openings (2), any number of which may be regulatable by dosage means as described above.

In another embodiment of the present invention, the device comprises protrusions (5) occupying more than 10%, preferably about or more than 20%, possibly 30%, 40%, 50%, 60%, or even 70% of the surface of the outer container (3) or, in case of an embodiment of the device wherein the reservoir (1) is only partially contained in the container (3), possibly also of the surface of the inner reservoir (1), which is not contained in the outer container (3).

In another preferred embodiment according to the present invention, the device comprises a plurality of openings on said protrusions (5) allowing for an efficient release of the dissolved in the interspace detergent composition once said device enters in contact with an item to be washed. Said openings can be of about or larger than 1 mm, 2 mm, 3 mm or 5 mm in diameter.

Said protrusions (5) can be made from any type of material selected from the group comprising: plastic, natural or synthetic rubber or fiber, depending on the type of items and conditions for washing. Preferably, the protrusions (5) will comprise rubber.

The outer container (3) and/or the inner reservoir (1) can be made out of any type of a material selected from the group comprising: any type of plastic, natural or synthetic rubber, or fiber. Furthermore, the outer container (3) and the inner reservoirs (1) can be made from the same material or from different materials.

In another embodiment of the present invention any of the outer container (3) or the inner reservoir (1) or both (1 and 3) can have transparent sections or be entirely transparent, allowing the user of the device to immediately see the type and quantity of detergent composition contained therein.

In another embodiment, wherein the inner reservoir would retain a liquid detergent composition of low viscosity (i.e. easy flow), the inner reservoir opening or openings (2) can be secured with a dissolvable plug of e.g. another detergent composition such as a soap, or with a soluble film to ensure efficient retaining of the low viscosity detergent composition inside of the inner reservoir (1) before the contact with water inside of the washing machine.

In a further embodiment of the present invention, the wall of the inner reservoir (1) can be entirely dissolvable in water, allowing for a very fast refilling of the device by simply placing a new dissolvable inner reservoir (1) inside of the outer container (3). Such walls can e.g. be made of soap or a soluble film and be filled with another type of soap, powder, or even liquid form of a detergent composition.

In another embodiment according to the present invention, said device is used as a laundry dosing and dispersing device.

The invention is further directed to a kit of parts comprising:

- a receptacle comprising a detergent composition, such as a bottle, a paste tube, a bag, a box, or even a cartridge comprising detergent flakes or powder etc., and
- the device of the invention for dosing and dispensing a detergent composition, said device comprising:
  - an outer container (3) defined by a container wall forming a container internal compartment and comprising at least one container opening (4) for brining said container internal compartment in fluid communication with an outer atmosphere;
  - an inner reservoir (1) defined by a reservoir wall forming a reservoir internal compartment for retaining a detergent composition, said reservoir being at least partially contained in said container (3) thus defining an interspace between the container wall and the portion of the reservoir wall contained in the container (3), said reservoir wall further comprising a reservoir opening (2) bringing said reservoir internal compartment in fluid communication with said interspace,
  - said device characterized in that the reservoir comprises no opening (2) that opens directly into the outer atmosphere;

wherein the device is removably attachable or attached to said receptacle.

As mentioned above, the receptacle comprising the detergent composition can be a bottle, a paste tube, a bag, a box, or even a cartridge, comprising at least a receptacle opening through which said detergent composition can be extracted.

Preferably the receptacle opening is easily engageable with the inner reservoir opening (2), allowing for easy refilling of the inner reservoir internal compartment with the detergent composition.

In one possible embodiment of the invention the receptacle is a plastic bottle comprising a liquid detergent composition and further comprising an opening secured by a plastic cap on which the device for dosing and dispensing the detergent composition of the invention is attachable or pre-attached and easily removable through a snap fitting connection or through a thread type of connection.

In another embodiment according to the invention, a kit of parts is provided comprising:

- the device of the invention for dosing and dispensing a detergent composition, said device comprising:
  - an outer container (3) defined by a container wall forming a container internal compartment and comprising at least one container opening (4) for brining said container internal compartment in fluid communication with an outer atmosphere; and
  - a optionally pre-mounted in said outer container (3) an interchangeable inner reservoir (1) defined by a reservoir wall forming a reservoir internal compartment retaining a detergent composition, said reservoir being in the pre-mounted state at least partially contained in said container (3) thus defining an interspace between the container wall and the portion of the reservoir wall contained in the container (3), said reservoir wall further comprising a reservoir opening (2) bringing in the pre-mounted state said reservoir internal compartment in fluid communication with said interspace and having no fluid communication into the outer atmosphere other than through said interspace; and
- a plurality of interchangeable inner reservoirs (1) (as described above) retaining a detergent composition.

The present invention also teaches a use of the interchangeable reservoirs (1) with the device according to the present invention.

The invention is further directed to a process for washing textiles in a washing machine with the device of the invention for dosing and dispensing a detergent composition, as described in any of the afore-mentioned embodiments, said method comprising the steps of: adding detergent composition in the inner reservoir (1), placing the inner reservoir (1) in the outer container (3) and securing the outer container (3), placing the device for dosing and dispensing a detergent composition inside the washing machine together with the textiles.

Lastly, the invention is also directed to a process of washing textiles in a washing machine comprising the steps of:

placing textiles inside the washing machine together with the device according to any of the afore-described embodiments, said device comprising a detergent composition in the reservoir (1); and running a washing programme in the washing machine.

The invention claimed is:

1. A device for dosing and dispensing a detergent composition, said device comprising:

an outer container defined by a container wall forming a spherical container internal compartment and comprising at least one container opening for bringing said container internal compartment in fluid communication with an outer atmosphere;

a hollow shaped spherical inner reservoir defined by a reservoir wall forming a reservoir internal compartment with a single reservoir opening, the reservoir internal compartment retains a detergent composition, said hollow shaped spherical inner reservoir being at least partially contained in said container thus defining an interspace between the container wall and the portion of the reservoir wall contained in the container, said a reservoir opening bringing said reservoir internal compartment in fluid communication with said interspace, the hollow shaped spherical inner reservoir opening faces the opposite direction from the one or more container openings;

wherein the hollow shaped spherical inner reservoir comprises no opening that opens directly into the outer atmosphere, and the hollow shaped spherical inner reservoir is detachably removable from the container and is interchangeable with another hollow shaped spherical inner reservoir.

2. The device according to claim 1, wherein the reservoir internal compartment comprises a detergent composition.

3. The device according to claim 2, wherein the reservoir opening is further coated by a water soluble film.

4. The device according to claim 2, wherein said detergent composition is provided in a form which, under standard conditions for temperature and pressure, prior to its at least partial dilution in water, does not spontaneously exit through the reservoir opening and enter into the interspace defined between the container wall and the portion of the reservoir wall contained in the container.

5. The device according to claim 1, wherein the external surface of the container wall comprises a plurality of protrusions, said protrusions comprising material selected from a group consisting of plastic, rubber, or fibre.

6. The device according to claim 5, wherein a number of said plurality of protrusions further comprise an opening.

7. The device according to claim 1, wherein the inner reservoir comprises at least two inner reservoir compartments.

8. The device according to claim 1, wherein the container wall comprises a plurality of openings and/or the reservoir wall comprises a plurality of openings.

9. The device according to claim 1, wherein the container comprises dosage device including a revolving attachment or a vertically-slidable element that can be partially to entirely slid over the container opening so as to vary the area of said opening.

10. The device according to claim 1, wherein the reservoir or its portion contained in the container is capable of performing rotational movements within said container.

11. A process of dosing and dispensing detergent in the device according to claim 1 as a laundry device comprising the steps of:

placing textiles inside the washing machine together with the detergent dosing and dispensing device, said device comprising a detergent composition; and running the washing machine.

* * * * *